United States Patent [19]

Marks et al.

[11] 4,062,165

[45] Dec. 13, 1977

[54] PLUG DEVICE AND METHOD AND APPARATUS THEREFOR

[76] Inventors: Ronald A. Marks, 23362 Burton St., Canoga Park, Calif. 91304; Neal Goldman, 108 S. Orlando Ave., Los Angeles, Calif. 90048

[21] Appl. No.: 684,998

[22] Filed: May 10, 1976

[51] Int. Cl.[2] ..... E02D 37/00

[52] U.S. Cl. ..... 52/514; 52/98; 52/741

[58] Field of Search ..... 52/514, 98, 99, 100, 52/741

[56] References Cited

U.S. PATENT DOCUMENTS

| | | | |
|---|---|---|---|
| 2,019,095 | 10/1935 | Robinson | 52/98 X |
| 2,536,665 | 1/1951 | Skoog | 52/514 X |
| 2,728,120 | 12/1955 | Snyder | 52/514 X |
| 3,325,955 | 6/1967 | Haut | 52/514 |
| 3,380,213 | 4/1968 | Hartman et al. | 52/514 X |
| 3,521,413 | 7/1970 | Scott et al. | 52/98 |
| 3,699,854 | 10/1972 | Doherty | 52/514 X |

*Primary Examiner*—Ernest R. Purser
*Assistant Examiner*—Carl D. Friedman
*Attorney, Agent, or Firm*—Nilsson, Robbins, Dalgarn, Berliner, Carson & Wurst

[57] ABSTRACT

A plug device for use in repairing an opening in a damaged wall portion of a double-walled structure. The device is composed of two elongated, preferably cylindrical, sections formed integrally in end-to-end relationship, and includes an adhesive backer. The device is inserted into the opening and secured at its distal end against the inner surface of the opposing wall. Upon severance and removal of the proximal section of the device, the surface of the intact member within the opening provides a rigid, fixed backing for patch material such as plaster, spackle or the like.

13 Claims, 5 Drawing Figures

FIG. 1
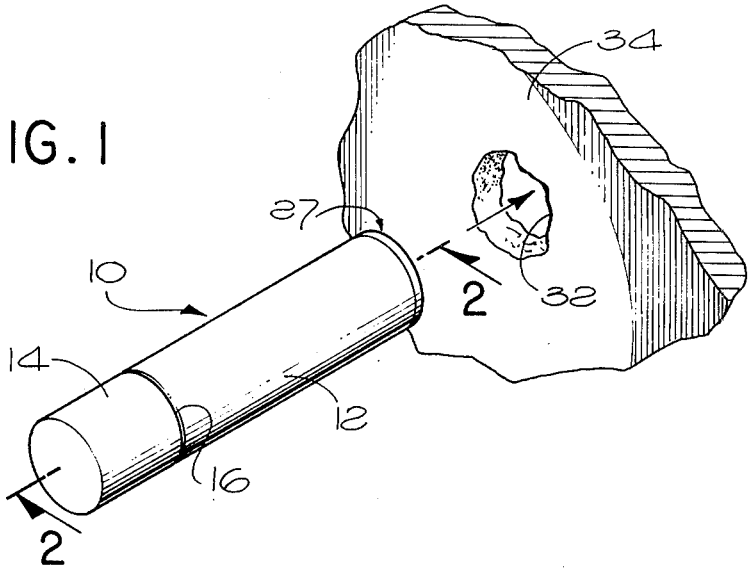
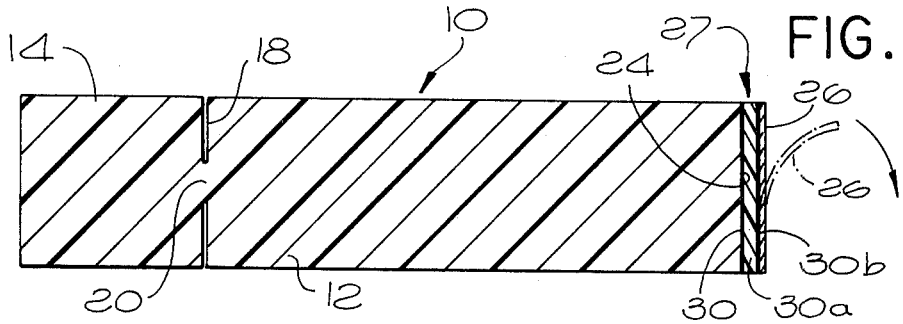
FIG. 2
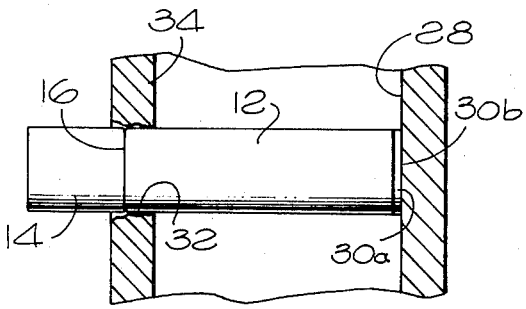
FIG.3
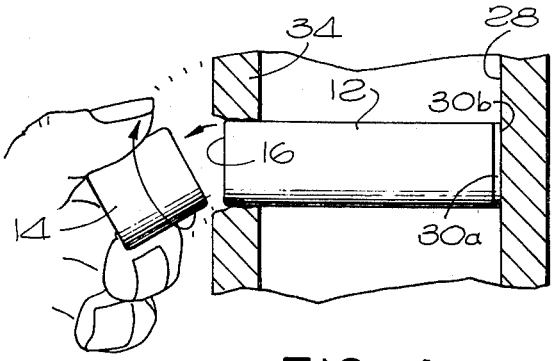
FIG. 4
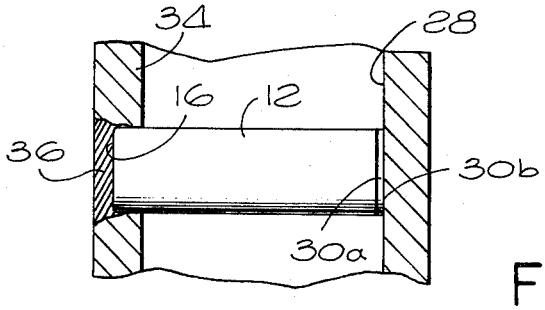
FIG. 5

PLUG DEVICE AND METHOD AND APPARATUS THEREFOR

FIELD OF THE INVENTION

The field of art to which the invention pertains includes the patching of damaged wall structures and, more specifically, of separately placeable members with surface forming sections supporting the patching material.

BACKGROUND AND SUMMARY OF THE INVENTION

Several devices for blocking an opening in a damaged wall, a ceiling, or a similar structure, have been reported in prior art. The damage may have been caused by an accident or by the removal or relocation of a toggle screw or an electrical outlet. The resulting holes, with diameters which can range from one-half of an inch to two or more inches, present a special problem. Unlike very small holes which can be patched over by the deposition of a settable material, or very large holes which can receive an insert cut from wall board or a similar material, medium-sized holes need a backing for patch filler such as plaster while it is being put into place. Most of the suggested devices include backing plates for the settable material, which are manoeuvered into position by special tools and/or complicated means. A number of systems include expansion members which are inserted through the holes and opened out at the rear of the wall, such as, for instance, the umbrella-type shaft of U.S. Pat. No. 3,325,955, or the folded hinge plate of U.S. Pat. No. 3,690,084 which is to be opened by pulling a drawstring. These particular devices are not only expensive to manufacture, but liable to introduce complications which offset any advantages to be gained from such construction. Other references of interest include U.S. Pat. No. 2,638,774, 2,997,416, 3,295,285 and 3,834,107. In several devices suggested by the prior art, metal screws or fasteners which hold the backing plates in place, project outwardly from the damaged wall and must be cut or filed off after the hole has been filled. Such operations are cumbersome and moreover, likely to dislodge the plaster which has been deposited in the hole. Moreover, after removal of the projecting part, another plaster deposit has to be applied to cover the severed surface.

The present invention provides a device for, and method of, repairing an opening in a damaged wall portion of a double-walled structure which overcomes the limitations of the prior art. More particularly, it provides an economical and easy to use plug device which is insertable into an opening and which includes a surface on which a patching material may be deposited. The plug device requires no special tools for installation. It is firmly anchored to the opposite wall to prevent shifting during the hardening of the patch material. No steps are required subsequent to the disposition of the patch material. The device can be used for holes of various depths and with various grades of roughness in the surrounding or backing wall structures.

In accordance with the invention, a cylindrical plug, made from plastic foam material, is composed of two sections of a predetermined, but unequal length, which are held in end-to-end relationship. The boundary between the two sections is defined by an annular cut-through region to provide a break away line thereat. Pressure sensitive adhesive can be provided on the distal end of the longer of the two sections. As the plug is inserted into the hole and pushed against the inside surface of the opposing wall, the adhesive contact holds it firmly against displacement and rotation. Once the plug has been put into place, the shorter of the two sections is broken off at the weakened boundary region, and the exposed surface of the longer section, positioned inwardly of the damaged wall, forms a backing for a patch filler material such as plaster, spackle or the like. The plug need not fit the hole shape exactly. In a preferred embodiment a coextensive portion of resilient material is attached to the adhesive material at the distal end of the longer plug section and includes, at its free end, another layer of pressure sensitive adhesive material, to be engaged by the surface of the opposite wall. The interposition of the resilient material serves to facilitate placement of the plug against a rough inner surface provided on wall structures of this kind. The plug can be provided in several diameters and in several lengths. It can be made to patch hollow doors as well as other double walls.

BRIEF DESCRIPTION OF THE DRAWINGS

FIG. 1 is a perspective view of a plug device in accordance with the present invention;

FIG. 2 is a cross-sectional view taken on the line 2—2 of FIG. 1;

FIG. 3 is a side elevational view of the plug device of FIG. 1 inserted into the opening and prior to the severance of a section thereof;

FIG. 4 is a side elevational view of the plug device of FIG. 1 inserted into the opening and separated from a break-away section thereof.

FIG. 5 is a side elevational view of the plug device of FIG. 1 inserted into the opening, with patch filler between the surface-forming end of the plug and the outer wall surface.

DETAILED DESCRIPTION

Referring now to FIGS. 1–5, there is shown an elongated plug 10, preferably cylindrical as shown, formed of plastic foam or the like, and comprising a main body section 12 and a break-away section 14 of shorter length, formed integrally in end-to-end relationship. A boundary 16 between the sections 12 and 14 includes an annular weakened area 18 at which the plug 10 is cut through, except for a central core region 20. A disc of pressure sensitive material such as double-sided tape 27 is adhered to the distal end 24 of the plug 10 and covered with a protective seal 26. In a preferred embodiment, shown more clearly in FIG. 2, the double sided tape includes a layer of resilient elastomeric material **30*a* coated with a pressure sensitive adhesive 30*b* which will permit securement of that end to a rough inner surface of the opposite wall 28. The elastomeric material 30*a*, which may be resilient plastic foam, such as polyurethane, is attached to the end 24 of the section 12 by pressure-sensitive adhesive 30. Such double-sided adhesive resilient material 27** is readily available, and can be used in a thickness range as low as 1/32 inch.

The plug 10 is introduced though the opening 32 of the wall 34 (FIG. 1) into the space between the double-walled structure shown in FIGS. 3–5, and represents a distinct, separately placeable member with a backing surface at the boundary 16 for a layer of filler material 36. Prior to its insertion through the wall 34, the protective seal 26 is peeled off the pressure sensitive adhesive **30*b* which coats the elastomeric material 30*a*** at the end 24 of the plug section 12 (FIG. 2), so that pressure applied axially against the plug 10 forces the adhesive 30*b* against the inner surface of the opposite wall 28. Once the plug 10 is firmly in position, the section 14 is broken off at the boundary 16 (FIG. 4) and removed, which leaves the section 12 recessed within the wall 34. Finally, filler material 36, which may be plaster, spackle or the like in a plastic state, is deposited on the backing surface provided by the proximal end of the plug section 12 to form a flush surface with the outer part of the wall 34.

It will be appreciated that the plug device, as described and illustrated heretofore, is of extremely simple construction, economical in manufacture and use, and applicable to repair holes of irregular shapes and various sizes in damaged walls or ceilings, as well as in hollow doors.

We claim:

1. A method of blocking an opening in a damaged wall portion of a double-walled structure having a front wall and a rear wall spaced therefrom, comprising the steps of:

inserting through said opening a cylindrical plug comprising a first section and a second section formed integrally in end-to-end relationship;

severing said second section from said first section and removing said second section; and depositing settable patch material on the outer surface end of said first section to fill the space between said surface and the surface of said front wall.

2. The method of claim 1 in which the distal end of said first section is provided with pressure sensitive adhesive and including the step of applying force axially against the proximal end of said plug to establish firm contact between said distal end and said rear wall.

3. A plug device for blocking an opening in a damaged wall portion of a double-walled structure having a front wall and a rear wall spaced therefrom, comprising:

a preformed elongated member, made from an expanded plastic foam material, insertable into said opening and including a first section and a second section formed integrally in end-to-end relationship; and a boundary surface between said first and second sections defined by an annular grooved region surrounding a central core defining a weakened recessed area for facilitating severance of said first and second section upon application of a sufficient force.

4. The plug device of claim 3 wherein said first section is longer than said second section.

5. The plug device of claim 3 wherein said sections are cylindrical.

6. A plug device for blocking an opening in a damaged wall portion of a double-walled structure having a front wall and a rear wall spaced therefrom, comprising:

a preformed elongate member insertable into said opening and including a first section and a second section formed integrally in end-to-end relationship;

a boundary surface between said first and second sections defined by a cut-through annular region surrounding a central core for facilitating severance of said first and said second section upon application of a sufficient force; and pressure-sensitive adhesive on the distal end of said first section for securing said section to said rear wall.

7. The plug device of claim 6 wherein said first section is longer than said second section.

8. The plug device of claim 6 wherein said sections are cylindrical.

9. The plug device for blocking an opening in a damaged wall portion of a double-walled structure having a front wall and a rear wall spaced therefrom, comprising:

a preformed elongate member insertable into said opening and including a first section and a second section formed integrally in end-to-end relationship;

a boundary surface between said first and second sections defined by a cut-through annular region surrounding a central core for facilitating severance of said first and said second section upon application of a sufficient force; and double-sided tape, having a thickness of at least 1/32 inch, on the distal end of said first section for securing said first section to said rear wall.

10. The plug device of claim 9 wherein said first section is longer than said second section.

11. The plug device of claim 9 wherein said sections are cylindrical.

12. A plug device for blocking an opening in a damaged wall portion of a double-walled structure having a front wall and a rear wall spaced therefrom, comprising:

a preformed elongate member, made from an expanded plastic foam material, insertable into said opening and including a first section and a second section formed integrally in end-to-end relationship;

a boundary surface between said first and second sections defined by a cut-through annular region surrounding a central core for facilitating severance of said first and said second section upon application of a sufficient force; and pressure-sensitive adhesive on the distal end of said first section for securing said first section to said rear wall.

13. A plug device for blocking an opening in a damaged wall portion of a double-walled structure having a front wall and rear wall spaced therefrom, comprising:

a preformed elongated member, made from an expanded plastic foam material, insertable into said opening and including a first section and a second section formed integrally in end-to-end relationship;

a boundary surface between said first and second sections defined by a cut-through annular region surrounding a central core for facilitating severance of said first and said second section upon application of a sufficient force; and double-sided tape, having a thickness of at least 1/32 inch on the distal end of said first section for securing said first section to said rear wall.

* * * * *